United States Patent [19]

Virr

[11] Patent Number: 4,969,404

[45] Date of Patent: Nov. 13, 1990

[54] ASH CLASSIFIER-COOLER-COMBUSTOR

[75] Inventor: Michael J. Virr, Fairfield, Conn.

[73] Assignee: Dorr-Oliver Incorporated, Milford, Conn.

[21] Appl. No.: 341,337

[22] Filed: Apr. 21, 1989

[51] Int. Cl.[5] ..... F23J 1/00

[52] U.S. Cl. ..... 110/165 R; 110/245; 122/4 D

[58] Field of Search ..... 110/171, 165 R, 245, 110/204, 205; 122/4 D; 431/7; 165/104.16

[56] References Cited

U.S. PATENT DOCUMENTS

| | | | |
|---|---|---|---|
| 4,330,502 | 5/1982 | Engström | 110/245 |
| 4,664,678 | 5/1987 | Rehmat et al. | 110/165 R |
| 4,693,682 | 9/1987 | Lee et al. | 110/245 |
| 4,700,636 | 10/1987 | Vogt et al. | 110/245 |
| 4,759,711 | 7/1988 | Ichiyanagi et al. | 110/245 |
| 4,777,889 | 10/1988 | Smith | 110/245 |
| 4,813,479 | 3/1989 | Wahlgren | 110/245 |

FOREIGN PATENT DOCUMENTS

| | | | |
|---|---|---|---|
| 1498034 | 10/1966 | France | 110/245 |

*Primary Examiner*—Edward G. Favors
*Assistant Examiner*—Denise L. F. Gromada
*Attorney, Agent, or Firm*—Harold M. Snyder

[57] ABSTRACT

A method for treating ash produced by waste coal fluidized bed boilers in which hot ash fines and heated secondary air are introduced into the boiler as the coarse ash is cooled. An ash treatment system for cooperation with a fluidized bed boiler operating on waste fuel having a high ash content receives and classifies hot ash from the boiler, returns ash fines to the boiler, cools coarse ash fines for disposal and burns carbon associated with the ash received from the boiler.

4 Claims, 3 Drawing Sheets

ASH CLASSIFIER-COOLER-COMBUSTOR

BACKGROUND OF THE INVENTION

1. Field of the Invention:

The invention is directed to an ash treatment system and process for use in the fluidized bed combustion of waste fuels having a high ash content.

2. Description:

Fluidized bed reactors are well-known means for generating heat and, in various forms, carry out processes such as drying, roasting, calcining, incineration and heat treatment of solids with gases in the chemical, metallurgical and other material processing fields. In the form of fluid bed boilers, steam is generated for use in driving electric power generation equipment, for process heat, for space heating, or for other purposes.

Fluidized bed reactors typically comprise a vessel in which a bed of particulate solids is present in the reaction chamber. Sufficient air or other gas is introduced into the vessel below the bed of particulate solids in a volume sufficient to achieve a gas velocity that expands or fluidizes the solids bed, suspending the particulate solids of the bed in the flowing air stream and imparting to the individual particles a continuous random motion with the fluidized bed as a whole resembling a boiling liquid. Conducting a combustion reaction in a fluidized bed has important advantages which include attainment of a substantially uniform bed temperature, combustion at relatively low temperatures and a high heat transfer rate.

Combustion of solid fuels such as coal in a fluid bed reactor involves the gasification of the organic component of the fuel leaving a residue of solid ash particles. When burning waste fuels of high ash content in a fluidized bed, the need to continuously remove from the combusting fluidized bed the relatively large quantities of red hot ash becomes a serious problem. In the reactor the very finest ash particles will be elutriated by the gases flowing in the reactor and will exit through the stack with the exhaust gases. Ash particles of somewhat larger particle sizes will become part of the fluidized bed where they improve the operation of the fluidized bed by retaining heat and contacting and igniting fresh fuel particles. The continuous motion of the ash particles in that fluidized bed brings about numerous collisions between ash particles in a softened condition due to the elevated temperature. Under such conditions, ash agglomerates readily form and these agglomerates grow to a size such that they are no longer fluidizable and they tend to descend toward the bottom of the fluidized bed coming to rest upon the air distribution plate located beneath the fluidized bed. Such an accumulation of large ash particles and large ash agglomerates on the air distribution plate will ultimately cause defluidization of the fluidized bed and subsequent shutdown.

Accordingly, it is well recognized that the accumulation of excess coarse ash particles and oversized ash agglomerates must be removed from the fluidized bed. As the coarse ash particles are removed from the bed, it is unavoidable that a substantial amount of ash fines are also removed. The ash removed is at a relatively high temperature and represents a heat loss, if steps are not taken to recover the heat. In addition, the ash particles removed from the fluidized bed invariably have associated with them a significant component of unburned carbon. The unburned carbon represents a loss of combustion efficiency and it would represent a much sought-after improvement if this carbon could be usefully burned to enhance reactor operation.

To exemplify the problem, a waste coal or anthracite may consist of two-thirds ash much of which is in the form of stone or rock and therefore tends to stay substantially in the same size range as the feed material to the fluidized bed boiler. A conventional cooler may be attached to the ash duct from the combustor with the ash cooled in a stream of cold air which also strips out the fines for return to the combustion compartment with the air. Such a unit is known as a classifier. Alternatively, the ash may be directed into a second fluidized bed and simply cooled with air or additional water-cooled tubes in the bed to remove the heat. Such a unit is a fluidized bed cooler. A third possibility is to simply have a water-cooled screw transporting the ash and removing the heat. These known devices have the disadvantage that they have only one function, cooling, or at most two, classifying and cooling at the same time.

As another consideration, fluidized bed boilers operating on waste fuels have to build up to a high carbon level in the combusting fluidized bed in order to achieve the proper combustion temperature which is typically about 1600° F. It will be understood that withdrawing the ash from the fluidized bed reactor not only removes heat from the reactor, but also removes unburned carbon which in the classifier or fluidized bed cooler largely goes to waste. A small amount of the carbon may be burned because of the air present, but the rapidly quenching nature of the cooler or classifier means that the reaction rate is not maintained and significant unburned carbon is ejected from the system in the ash. This, of course, negatively impacts on overall boiler and system efficiency.

Some of the related prior art is indicated below with comment on the disclosed subject matter.

U.S. Pat. No. 4,700,636, issued Oct. 20, 1987 discloses an ash classifier device for returning ash fines to a fluidized bed reactor while collecting coarse ash particles for disposal. Only minor cooling of the ash particles is effected.

U.S. Pat. No. 4,598,653, issued July 8, 1986, discloses a combustion system in which fine particles are separated from coarse particles in a gas stream with entrained fine particles combusted in an upper combustor and coarse particles combusted in a lower compartment which may be a bubbling fluid bed combustor. There is provision for returning uncombusted particles to the upper or lower compartment.

U.S. Pat. No. 4,330,502, issued May 18, 1982, discloses a modified fluidized bed reactor having an ash classification system for separating and returning fines to the reactor while discharging coarse particles from the reactor.

U.S. Pat. No. 4,301,771, issued Nov. 24, 1981, discloses a fluidized bed reactor with internal structure for separating fines from the combustion gases and returning them to the fluidized bed.

U.S. Pat. No. 3,397,657, issued Aug. 20, 1968, discloses a fluidized bed reactor wherein non-inflammable materials are separated and discharged from the system while the fluidized medium (fines) are returned to the reactor.

U.S. Pat. No. 3,001,228, issued Sept. 26, 1961, discloses a fluidized bed system for coating and pelletizing fusible materials. The process involves coating molten droplets with solids in an upper fluidized bed and collecting the coated pellets in a lower fluidized bed. Excess particles are removed from the lower fluidized bed to a fluidized bed maintained in an excess particle compartment.

SUMMARY OF THE INVENTION

The ash treatment system of the invention comprises one or more vessels or cells in which hot ash from a fluidized bed boiler is received and first classified to separate the fine and coarse ash fractions. The fine fraction is returned to the boiler and the coarse fraction is further treated by exposure to large volumes of air to secure combustion of the unburned carbon in the ash. The coarse ash fraction is thereafter cooled in a fluidized bed environment with the fluidizing air heated by contact with the ash and the heated air is retained in the process so that the sensible heat thereof may be utilized.

In a first aspect of the invention, an ash treatment vessel is located externally of the fluidized bed reactor or boiler with which it cooperates. The ash treatment vessel is connected to the reactor by at least two conduits; the first for receiving a hot ash solids feed with a carbon component from the reactor and, the second, for returning ash fines, some carbon particles, and hot gas to the reactor. Air is introduced into the ash vessel at a lower portion thereof through tuyeres spaced from the bottom of the ash vessel. The volume and velocity of air introduced by the tuyeres is sufficient to establish a fluidized bed in the lower portion of said vessel, to burn significant amounts of carbon in the feed and entrain fines from the solids in the vessel volume above the level of air introduction, while permitting coarse ash to fall through an upward flow of air to the bottom of the vessel where it accumulates below the level of air introduction in the fluidized bed. Entrained fines, which include hot ash fines and some small amount of unburned carbon particles, pass upward with hot gas into the conduit which returns the solids and gas to the fluidized bed reactor or boiler. The air introduced into the ash vessel as fluidizing air is heated by contact with the fluidized hot ash and, further, by the combustion of carbon particles which occurs in the vessel. The coarse ash falls into the fluidized bed at the bottom of the ash vessel where it is cooled, some ash dropping out of the fluidized bed into an accumulation volume provided below the level of air introduction. As necessary, the ash in the accumulation volume is withdrawn from the vessel for disposal through a valved conduit which opens into the vessel bottom.

In a second aspect of the invention, the ash treatment system comprises a modified ash treatment vessel with one or more cooperating ash cooling cells. In this embodiment of the invention, the modified ash treatment vessel carries out the classification of ash received from the boiler and the combustion of unburned carbon present in the ash, but effects little or no cooling of the ash. The cooling function is conducted by one or more fluidized bed cooling cells associated with the ash treatment vessel. One such cooling cell adjoins the ash treatment vessel and is in communication with the fluidized bed of the ash treatment vessel by means of a submerged weir. As ash is added to the ash treatment vessel the level of the fluidized bed therein tends to rise, but due to the fluidized nature of the bed, excess ash material flows past the weir into the fluidized bed of the adjoining cooling cell. The ash material in the fluidized bed of the cooling cell is cooled by the fluidizing air, while the air is heated in traversing the bed and this hot air is returned to the boiler through a connecting conduit. A series or train of fluidized bed cooling cells may be connected to the first cooling cell, each having a submerged weir providing communication with its neighbor. The heated air produced by each cooling cell may be returned to the boiler by a connecting conduit. Each such cooling cell can reduce the ash temperature by several hundred degrees (° F) so that the ash withdrawn from the system is at a temperature which can be readily handled.

DETAILED DESCRIPTION OF THE INVENTION

Figure 1:
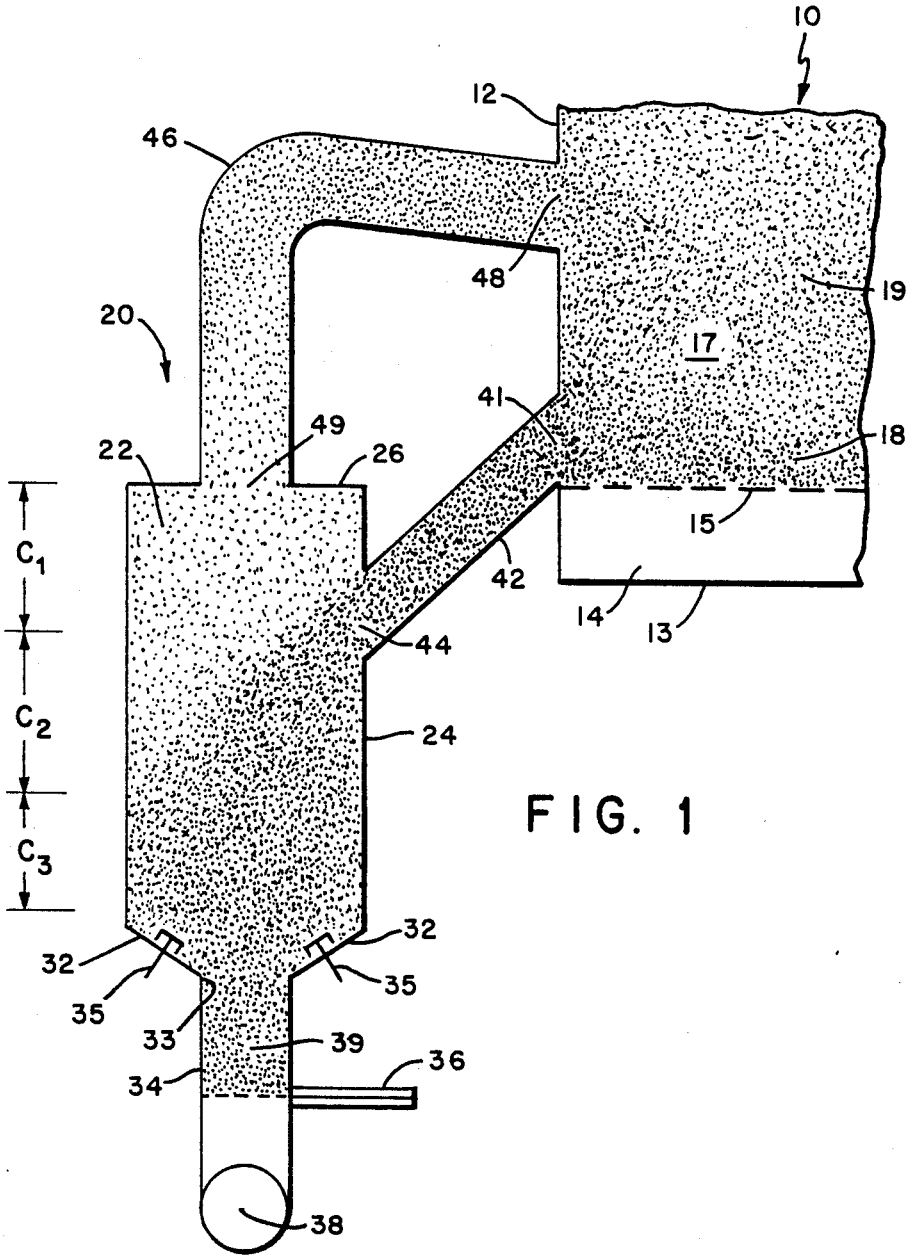
FIG. 1 is a schematic view of the ash treatment system of the invention connected to a fluidized bed boiler.

Referring to FIG. 1, there is illustrated a fluidized bed reactor or boiler 10 connected to the ash treatment system 20 in accordance with the present invention. The fluidized bed reactor 10 is only partially shown and comprises a sidewall 12 which may be of water-wall construction in the case of a boiler and a bottom wall 13. Within the reactor there is an air distribution plate 15 which divides the interior space of the reactor into a windbox 14 below the air distribution plate 15 and a reaction chamber or combustion volume 17 above the air distribution plate 15. Means (not shown) such as a blower is provided for introducing a large volume of air into the windbox 14. Fluidized bed material 18, 19 is located above the air distribution plate 15 within the combustion chamber 17.

The ash treatment system 20 comprises an ash vessel 22 located at a generally lower level than the fluidized bed reactor 10 and an arrangement of conduits connecting the ash vessel to the fluidized bed reactor. The ash vessel has a top wall 26, a side wall 24, while the bottom of the reactor is formed by a slanted or inclined wall portion 32 which is intermediate sidewall 24 and a centrally located outlet port 33 to which ash disposal conduit 34 is fixed. A plurality of tuyeres 35 pass through inclined wall portion 32 and are inclined inwardly of the side wall 24 to direct streams of air into the interior of vessel 22. The ash disposal conduit 34 has a controlling valve 36 positioned therein. A downwardly inclined ash conduit 42 connects ash exit port 41 in the lower portion of the fluidized vessels bed reactor 10 just above the air distribution plate 15 with the ash vessel through a hot ash inlet port 44. A shut-off valve (not shown) may be provided in conduit 42. A return conduit 46 connects the ash vessel with the fluidized bed reactor through a gas/solids outlet port 49 in the top wall or roof 26 of the ash vessel and a return port 48 in the wall 12 of the fluidized bed reactor.

In operation, the fluidized bed reactor or boiler 10 has within the combustion chamber 17 a body of particulate matter 18, 19 which is supported above the air distribution plate 15. Air supplied by a blower to the windbox 14 moves through the perforations of the air distribution plate 15 into the bed material 18, 19 and expands that bed to a substantial height within the combustion chamber 17. The expanded bed material may not have a distinct upper surface and there may be a dilute concentration of very fine particles in the upper part of the combustion chamber 17. The fine particles tend to leave the fluidized bed boiler through the exhaust stack (not shown) of the boiler with the exhaust gases, but centrifugal means, such as a cyclone, may be provided in the exhaust system to separate and capture fines for return to the boiler. With the bed material 18, 19 at elevated temperature, the air introduced through the air distribution plate 15 serves as combustion air to burn the carbon in the fuel in the combustion chamber 17. The incombustible ash constituent of the fuel generally remains as discrete ash particles in the fluidized bed, thereby serving a useful function as hot particles contacting incoming fuel particles and igniting them, and further, aiding and maintaining the fluidized condition of the fluidized bed. However, due to the fact that the fine ash particles contact each other due to their continuous motion in the fluidized bed and because they are incandescently hot, agglomeration of the softened particles does occur. As the particles grow, they are less susceptible to fluidization and they tend to descend to a lower level in the fluidized bed just above the air distribution plate 15. This region of coarser ash particles is indicated at 18 in FIG. 1, while region 19 represents finer particles located higher in the combustion chamber 17.

The ash exit port 41 in the wall 12 of the fluidized bed reactor is positioned at a level just above the air distribution plate 15 convenient to the level of the region 18 of coarse ash particles in the fluidized bed. The fluidized coarse ash particles move into the inclined ash conduit 42 and so pour into ash vessel 22 through hot ash inlet port 44.

As shown in FIG. 1, for purposes of discussion, the interior of the ash vessel 22 is shown as being divided into three sections, C1, C2 and C3. In fact, there are no boundaries or walls between the three indicated sections, and the interior volumé of the ash vessel 22 is unobstructed. The coarse ash particles flowing through hot ash inlet port 44 meet a rising current of air introduced through the tuyeres 35 in the lower portion of the ash vessel as well as combustion gases generated in the ash vessel as will be described. The rising gases within the ash vessel 22 strip the fine ash particles from the introduced ash feed and, entrained in the gases, the fine particles exit the ash vessel through the gas/solids outlet port 49, traverse the return conduit 46 and pass into the combustion chamber 17 of the fluidized bed reactor 10 through the return port 48.

The classification action, as described, takes place approximately in section C1 of the ash vessel 20. In that region the upflowing air current entrains the fine ash particles as it proceeds toward the return conduit 46 while the coarser ash particles fall counter-current to the air stream into the region labeled C2, which is designated the carbon combustion region. In region C2 the hot coarse ash particles with their carbon component are thoroughly exposed to the rising air stream and rapid combustion of the carbon proceeds. This combustion results in an increase in the gas temperature in the region C2 and produces a substantial volume of hot combustion gases which move with the air stream through region C1 and return conduit 46 to enter the fluidized bed reactor at return port 48 so as to maintain the temperature within reaction chamber 17. The carbon-poor coarse ash particles continue their descent into region C3, designated the cooling region. In region C3 there is a fluidized bed of relatively coarse ash particles sustained by air flow through the tuyeres 35, but in the large central ash disposal conduit 34 there is a buildup of ash particles dropping out of the fluidized bed in region C3 below the level of tuyeres 35 to form a quiescent body 39 of ash particles in the accumulation volume lying above valve 36. During the residence time of the ash particles in the fluidized bed in region C3, they undergo substantial cooling due to the large volumes of air introduced through the tuyeres 35. Of course, in traversing the fluidized bed of ash particles, the air is heated before its entrance into region C2.

Control of cooled particulate removal is effected by valve 36 which is opened to drop the quiescent body 39 of ash particles from the accumulation volume in and above conduit 34 so as to remove them from the operation by, for example, a water-cooled screw 38 which may effect a further reduction in temperature of the ash disposed as it is conveyed away. Alternatively, the ash may already be cool enough (typically less than 800° F.) to enter the ash conveying mechanism.

Thus it is seen that the ash treatment system 20 rather simply accomplishes the necessary functions of classification, carbon burn-up and cooling.

Figure 2:
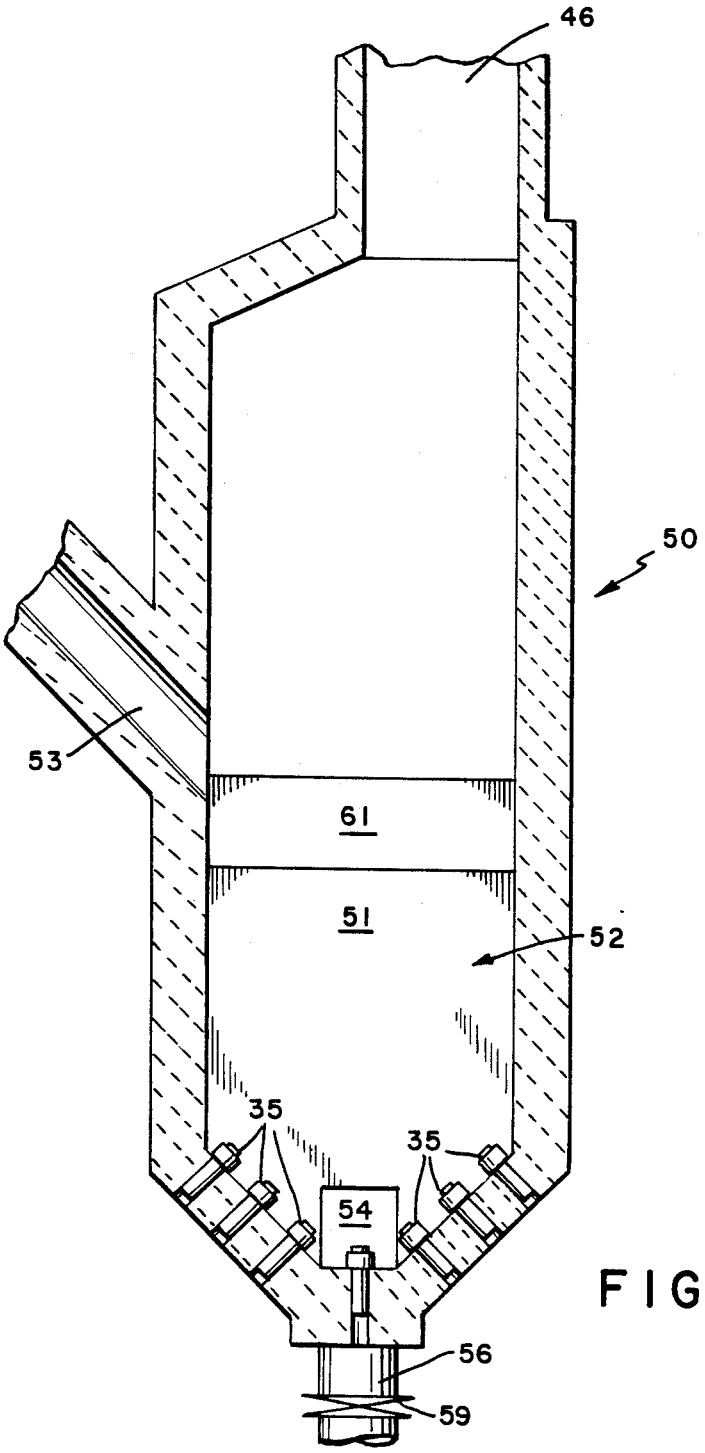
FIG. 2 shows a front sectional view of a further embodiment of the invention in which the ash treatment vessel is connected to a plurality of ash cooling vessels.
Figure 3:
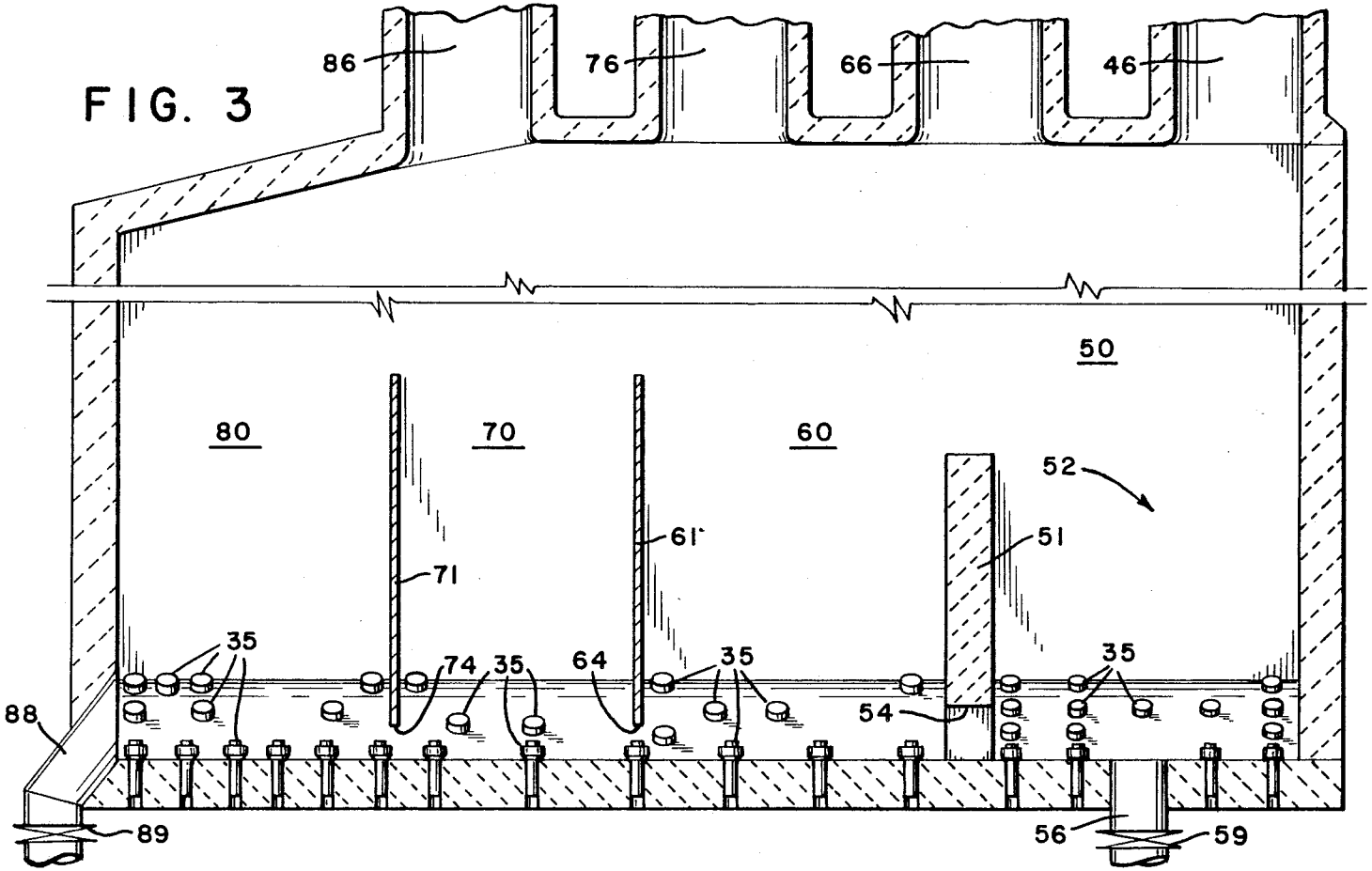
FIG. 3 is a side sectional view of the embodiment of FIG. 2.

Referring to FIGS. 2 and 3, there is illustrated another embodiment of the invention wherein a modified ash vessel or burn-up cell 50 is combined with a number of fluidized bed cooling cells. In this embodiment, the ash vessel 50 carries out the functions of classifying and carbon burn-up, but does not significantly cool the ash under treatment. Thus, ash fed into the fluidized bed 52 of ash vessel 50 is at a temperature in the range of about 1550 to 1650° F. The purpose of the fluidized cooling cells 60, 70 and 80, then, is to achieve a substantial decrease in the ash temperature. Thus, with three cooling cells as shown in FIG. 3 the temperature of the ash can be reduced to a level of about 300–400° F. at which temperature the ash can be more easily handled by a conventional ash system. In addition the air passing through the fluidized bed of ash in each cell can be conveyed back to the boiler from each cell at the combined temperature thus acting as a secondary air heater and recovering the heat from the ash and returning it to the boiler.

The ash treatment vessel 50 of this embodiment has a submerged weir 54 provided in the dividing wall 51 of the ash treatment vessel at a level just below that of the highest row of tuyeres 35 to provide communication between the fluidized bed in the ash vessel and the fluidized bed of the adjacent cooling cell 60. In turn, the cooling cell 60 has a submerged weir 64 at a low position of wall 61 within the fluidized bed for communication with a second cooling cell 70. The cooling cell 70 has its own submerged weir 74 in wall 71 for communication with the last of the series of cooling cells 80. The cooling cell 80 has a port 88 through which the ash from the fluidized bed in cooling cell 80 can exit for disposal by operation of valve 89. The ash vessel 50 has a return conduit 46 for returning fine ash and hot gases to the boiler and each of the cooling cells has an exhaust conduit 66, 76, 86 for returning heated air to the boiler. The ash vessel 50 is provided with a discharge conduit 56 in the bottom thereof for withdrawing fluidized bed solids from the vessel through operation of valve 59 in conduit 56.

While three cooling cells have been shown in this embodiment, the precise number of cooling cells will depend upon the application and may be either more or less than that shown. Also, overflow weirs may be provided instead of the underflow weirs illustrated.

As has been mentioned previously, material is received by the ash treatment vessel from the boiler combustion chamber at approximately 1600° F. The ash in the burn-up cell 50 is kept at a combustion temperature of 1550–1650° F. in order to burn out the carbon in the ash emerging from the fluid bed combustor. The ash in the fluidized bed of the burn-up cell 50 passes into the first cooling cell 60 wherein it is cooled by the fluidizing air down to a temperature in the range of 900–1100° F. In the second cooling cell 70 the temperature of the ash is reduced to the range of from 600–700° F. and in the third cooling cell 80 the temperature of the ash is reduced to 300–400° F.

In this way, the sensible heat that would otherwise have been lost in disposal of the hot ash is regained and typically decreases the ash temperature from 1600° F. to 325° F. representing approximately 5% in boiler efficiency. Reducing the carbon in the ash from 2.5–3% on exiting the boiler to less than 0.5% on exiting the ash cooler also gains over 2.5% in boiler efficiency by increasing the combustion efficiency. Thus, overall, the combination of ash treatment vessel and coolers enables an efficiency gain of approximately 7.5% to be achieved. This is a significant gain in efficiency when burning poor grade fuels such as anthracite culm or coal collery waste ("gob") because these fuels typically have a low calorific heat content in the range of 2900–3500 Btu/lb. Even with higher heat content fuels in the range of 3500–8500 Btu/lb significant gains in combustion and overall boiler efficiency can be made.

I claim:

1. An ash treatment system for a fluidized bed reactor or boiler comprising, a. an enclosed ash treatment vessel having a gas/solids outlet port through the top thereof, a hot ash inlet port through the side wall thereof, and an ash discharge means at or near the bottom thereof, b. an ash conduit connecting said hot ash inlet port of said vessel to the fluidized bed region of said fluidized bed reactor or boiler for receiving hot ash having an unburned carbon component from the fluidized bed in said reactor or boiler, c. a return conduit connecting the gas/solids outlet port of said ash treatment vessel with the combustion chamber of said fluidized bed reactor or boiler for routing air and combustion gases at elevated temperature and entrained hot ash fines to said combustion chamber.

d. a plurality of tuyeres at the bottom of said ash treatment vessel for directing a flow of air upwardly into said ash vessel to form a fluidized bed, to support combustion of said carbon and for entrainment of solids, and e. at least one fluidized cooling cell adjustment said ash treatment vessel wherein said ash discharge means is a submerged weir in the wall of said ash treatment vessel connecting the fluidized bed in said vessel with a fluidized bed in said cooling cell.

2. The ash treatment system of claim 1 wherein said fluidized bed cooling cell is provided with exhaust conduit means for forwarding heated air rising from the fluidized bed to said fluidized bed reactor or boiler as secondary air.

3. The ash treatment system of claim 1 including a train of fluidized bed cooling cells connected to said ash treatment vessel with the fluidized bed of each cell connected to that of its neighbor by means of submerged or overflow weirs, each of said cells having exhaust conduit means for forwarding heated air from its fluidized bed to said fluidized bed reactor or boiler as secondary air.

4. A process for treating hot carbon-containing ash flowing from a fluidized bed reactor or boiler comprising the steps of:

(1) classifying the ash in a rising gas stream into fine and coarse fractions, (2) burning a substantial amount of the carbon in the descending coarse ash fraction by exposure to a rising air stream to produce hot combustion gases, (3) returning the fine ash fraction entrained in a hot secondary air/combustion gas mixed stream to said reactor or boiler to recover residual carbon and the sensible heat of the solids and gases, (4) gathering the coarse carbon-poor ash for cooling in a fluidized bed cooling cell structure distinct from the vessel in which steps (1) and (2) above are carried out wherein the fluidizing gas is air and is heated in traversing the fluidized bed, (5) utilizing the heated air produced in step (4) to burn the carbon in step (2), (6) withdrawing the coarse cooled ash from the process.

* * * * *

UNITED STATES PATENT AND TRADEMARK OFFICE

CERTIFICATE OF CORRECTION

PATENT NO. : 4,969,404

DATED : November 13, 1990

INVENTOR(S) : Michael J. Virr

It is certified that error appears in the above-identified patent and that said Letters Patent is hereby corrected as shown below:

IN CLAIM 1, COLUMN 8, LINE 2, CHANGE THE PERIOD (.) TO A COMMA (,).

SAME CLAIM, COLUMN 8, LINE 8, AFTER "FLUIDIZED" INSERT --BED--. SAME LINE, CHANGE "ADJUSTMENT" TO ADJACENT--.

Signed and Sealed this

Third Day of March, 1992

*Attest:*

HARRY F. MANBECK, JR.

*Attesting Officer*

*Commissioner of Patents and Trademarks*